US006234126B1

(12) United States Patent
Kaye

(10) Patent No.: US 6,234,126 B1
(45) Date of Patent: May 22, 2001

(54) ENGINE VALVE CONTROL

(76) Inventor: Vincent Kaye, 5163 Kellen Ct., Bloomfield Hills, MI (US) 48302

( * ) Notice: Subject to any disclaimer, the term of this patent is extended or adjusted under 35 U.S.C. 154(b) by 0 days.

(21) Appl. No.: 09/427,881

(22) Filed: Oct. 27, 1999

(51) Int. Cl.[7] ..... F01L 1/26; F01L 1/18; F02B 75/02

(52) U.S. Cl. ..... 123/90.23; 123/90.2; 123/90.39; 123/65 VD

(58) Field of Search ..... 123/90.25, 90.24, 123/90.39, 90.41, 90.61, 90.2, 90.22, 90.23, 65 VD; 91/303

(56) References Cited

U.S. PATENT DOCUMENTS

| | | | | |
|---|---|---|---|---|
| 235,318 | * | 12/1880 | Vaile | 91/303 |
| 408,400 | * | 8/1889 | Beatty | 91/303 |
| 988,344 | * | 4/1911 | Holzmueller | 123/78 E |
| 1,308,123 | * | 7/1919 | Spohrer | 91/303 |
| 3,610,218 | | 10/1971 | Durham . | |
| 3,626,469 | | 12/1971 | Ashley | 123/90.25 |
| 4,364,341 | | 12/1982 | Holtmann | 123/90.17 |
| 4,722,306 | * | 2/1988 | Fujikawa et al. | 123/90.2 |
| 4,723,515 | | 2/1988 | Burandt | 123/90.16 |
| 4,887,564 | | 12/1989 | Edwards | 123/90.25 |
| 5,099,805 | | 3/1992 | Ingalls | 123/90.15 |
| 5,231,959 | | 8/1993 | Smietana | 123/90.12 |
| 5,483,929 | | 1/1996 | Kuhn et al. | 123/90.1 |
| 5,588,403 | | 12/1996 | Williams | 123/90.11 |
| 5,615,646 | | 4/1997 | Feucht | 123/90.12 |
| 5,732,670 | | 3/1998 | Mote, Sr. | 123/90.24 |

FOREIGN PATENT DOCUMENTS

| | | | | |
|---|---|---|---|---|
| 345991 | * | 12/1922 | (DE) | 91/303 |

* cited by examiner

*Primary Examiner*—Wellun Lo
(74) *Attorney, Agent, or Firm*—Harness, Dickey & Pierce, PLC

(57) ABSTRACT

An engine having a cylinder, piston having a skirt having an actuating member, a upper rocker-arm being pivotally coupled to the intake valve, a first push-rod, said being pivotally coupled to the upper rocker arm, a lower rocker-arm being pivotally connected to the push-rod, the lower rocker-arm being positioned so as to engage the actuating member of the piston.

1 Claim, 4 Drawing Sheets

ENGINE VALVE CONTROL

SUMMARY AND BACKGROUND OF THE INVENTION

For many years, attempts to adapt two cycle internal combustion engine concepts to replace conventional multi-cylinder four cycle applications have met with failure. Some, but not necessarily all, of the causes for these failures are (a) excessive and uncontrollable exhaust emissions which result in completely unacceptable amounts of atmospheric pollution's; (b) very short operational life (typically approximately 20%) due primarily to common and typical two cycle engine designs; (c) the necessity to use combustion air to carry fuel as well as lubricating oil into the combustion chamber which creates a myriad number of problems for many operators.

Proof of these totally unacceptable conditions (among many others) has been published in newspapers throughout the world and by virtually all the major manufactures of automobile engines.

This invention overcomes all of the existing shortcomings of present day two cycle engine configurations, especially those mentioned above and provides a practical, efficient, clean-burning, power source for virtually all internal combustion engine requirements throughout the world. All with cost savings of about 50% of present day four cycle engine applications.

Today's four-cycle internal combustion engines are marvelous and fantastic results of millions of dollars and engineering hours of development, design and materials applications. Equipment and processes have been continually improved for the last 100 years and, with the cooperation of the chemical and petroleum industries, the public today drives vehicles with internal combustion multi-cylinder engines with 100,000 (or more) miles of life warranties.

This two cycle engine concept retains every one of these improved materials and manufacturing processes and with (among other) advantages: engines will have (a) approximately one half of the weight; (b) approximately one half of the physical size; (c) approximately one half of the cost; and (d) virtually no changes in present day materials and manufacturing facilities, process and equipment.

For example, in today's automotive market, the six-cylinder "V" configuration engine is utilized very extensively. Retaining physical dimensions of bore and stroke, horse power and torque, and all other amenities, this six-cylinder engine could be replaced with a three cylinder two-cycle engine using the same engine components, and still retain all the engine statistics available in the four-cycle configuration.

In every four-cycle engine, only one half of the cylinders produce power strokes for each 360° rotation of the crankshaft. The "idle" remaining cylinders are USING energy, exhaling exhaust gases or inhaling fresh air.

In this two-cycle engine concept, each and every cylinder/piston unit produces a power stroke for each 360° rotation of the crankshaft. The functioning of a two-cycle engine is known in the art but will be repeated here to provide a basis to understand the invention disclosed herein.

1. Fuel is injected into the cylinder early in the air compression portion of the upward travel of the piston. Note: combustion air had been supplied to the cylinder as described later.

2. Air and fuel (fuel supply controlled by the throttle control position and associated electronic circuitry) are further compressed until the piston reaches top dead center.

3. At the appropriate time, electronically controlled ignition occurs and the piston produces its power stroke.

4. As the piston approaches the bottom of its stroke, combustion has ceased and the extreme pressures within the cylinder have abated. The exhaust valve(s) starts to open (the lower tappet arms may also be moved by means of metal actuating arms attached to the connecting rod instead of the extensions added to the piston skirt) and pressure in the cylinder is reduced almost to atmospheric pressure as the exhaust gases are expelled into the exhaust manifold and to the exhaust control system.

5. Within a few more degrees of crankshaft rotation the intake valve(s) start to open (the lower tappet arms may also be moved by means of metal actuating arms attached to the connecting rod instead of the extensions added to the piston skirt) and fresh air (under pressure) enters the cylinder, as described later.

6. Since both valves are now open, fresh air continues to enter the cylinder and, of course, some of the fresh air exits via the open exhaust valves. This action will continue until both the exhaust and intake valves close. Fresh air through the cylinder exiting into the exhaust system will purge the cylinder of any remaining exhaust products.

7. As the piston starts its compression stroke both valves will close and the compression cycle will start.

As described above, the function of a two-cycle engine begins with combustion air (under pressure) entering the cylinder from the intake manifold and via the intake valve (s). Fuel is then injected into the cylinder after the exhaust and the intake valves are closed. The fuel/air mixture is compressed, and ignition of the compressed fuel/air mixture is performed while the piston is at the top of its stroke. The products of combustion are released into the exhaust system via the conventional exhaust valves.

As is known, in conventional four-cycle engines, intake and exhaust valves have been predominantly operated by tappet arms, which in turn have been operated by a combination of timing gears, timing belts and cam shafts. Other systems which use solenoids and hydraulics have not proven satisfactory to operate intake and exhaust valves.

The combinations of cam shafts and gears used in four-cycle engines have been refined extensively but are not suitable for two cycle operation. Furthermore, these components are some of the most expensive parts of modern internal combustion engines.

Modern valves in the cylinder head (the number of valves per cylinder does not affect this invention), open by means of tappet arms pressing on the ends of valve stems and are closed by valve springs when the tappet arms are released by the cam shaft and associated mechanisms.

The valves in this two-cycle engine are also operated by tappet arms of a slightly different design. Instead of the vertical motion being imparted by the camshaft, the tappet or rocker arm is caused to move by means of a push (or pull) rod. This push (or pull) rod [depending on design] is, in turn connected to a second tappet arm, (somewhat similar to the upper tappet arm) but its fulcrum bearing is fastened to the lower cylinder block (or to a support bracket), at the bottom of the cylinder block.

One arm of the lower tappet arm extends into the area of the cylinder bore enough to be contacted by a hardened extension of the skirt of the piston. Thus, before the piston reaches bottom dead center, the extension built into the piston skirt (or attached thereto) will contact the lower tappet arm opening or closing valves as needed.

As such, it is an object of the present invention to provide a two-cycle combustion engine which:

1. Embodies means to operate air intake and exhaust valves to emulate the functions of the air intake and exhaust ports, which are used in virtually all present day two-cycle engines;

2. The number of air intake and exhaust valves per function and per cylinder is limited only by design;

3. Valve timing is consistently precise;

4. Valve life is limited only by available designs and technology;

5. No unique or exotic design or construction conditions are required;

6. Allows for the use of a standard fuel injector; and

7. Allows for the lubricating oil to be in the crank case as opposed to in the fuel which is normal for a two-cycle engine.

DETAILED DESCRIPTION OF THE PREFERRED EMBODIMENT

Figure 1:
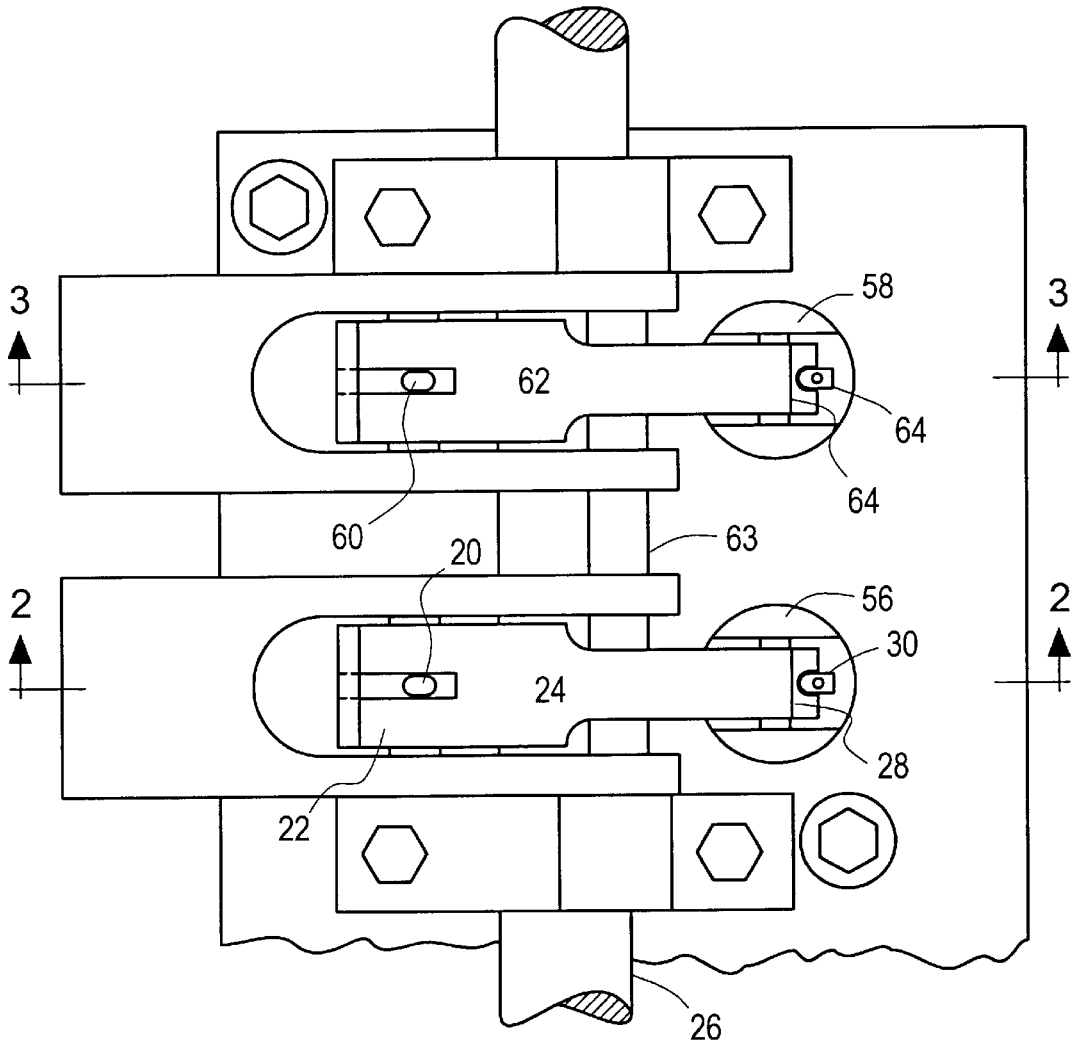
FIG. 1 shows a top view of the upper rocker-arms to control the exhaust and intake valves.

FIG. 1 shows a top view of the upper rocker-arms for a single piston cylinder for the current invention. This design allows for the use of any number of cylinder/piston assemblies. As a power stroke is produced for each rotation of the crank shaft, considerable weight and fuel savings can be obtained. As can be seen, the exhaust 60 and intake valves 20 are pivotally connected to the upper rocker-arms 24,62. These upper rocker-arms 24,62 are pivotally connected to the engine block by pin 63. The second end of the upper rocker-arms 24, 62, the push-rods 30,64 are shown. As is known in the art, valve spring mechanisms 56,58 can either be incorporated around the push-rods or on top of the upper rocker-arms to return the valves 20, 60 to either a closed or open position depending on design. As can be appreciated, these actuating springs can also be incorporated so as to apply forces to the lower rocker or tappet arms to maintain the valve in a closed or open position depending on design.

Figure 2:
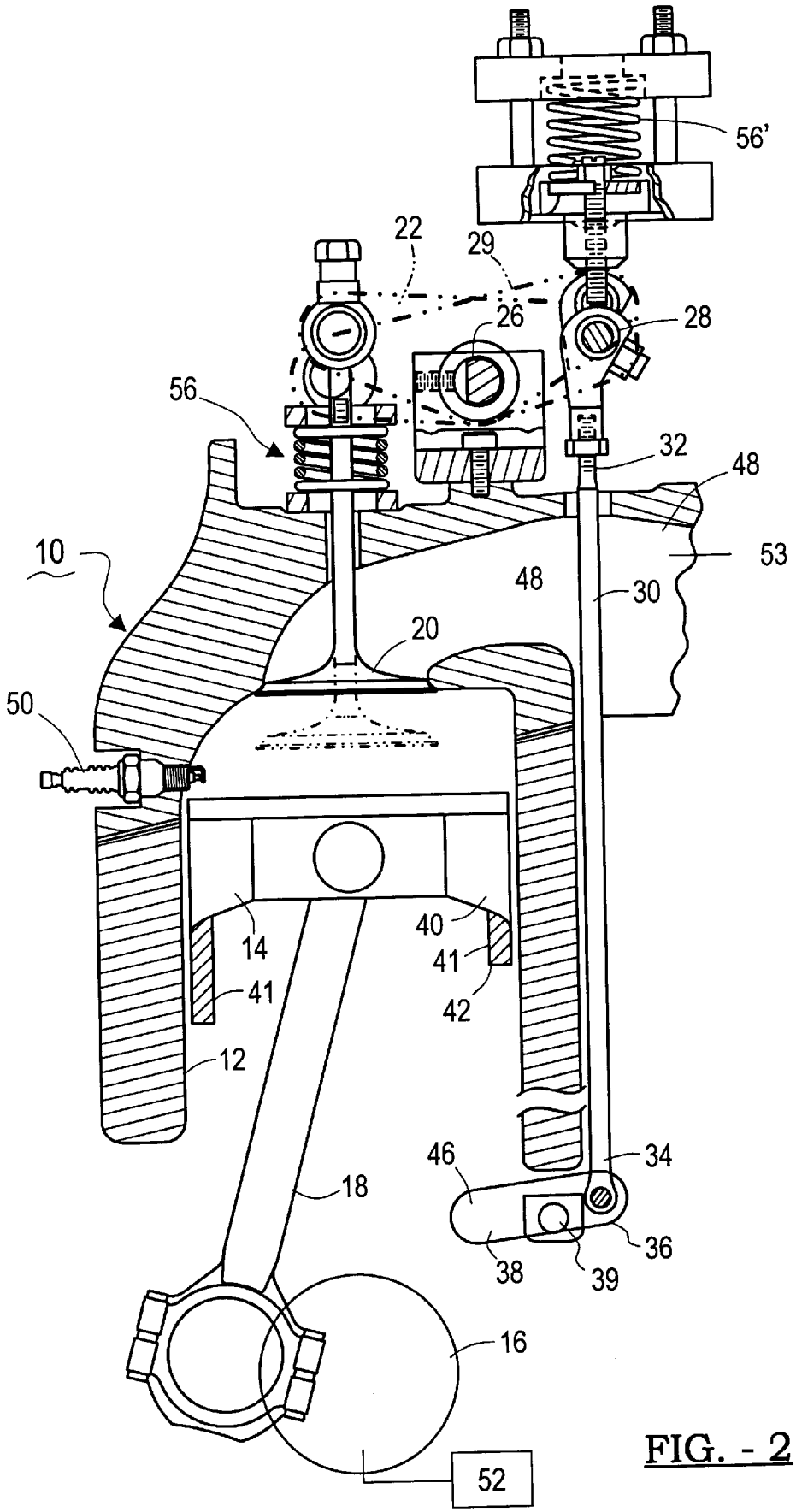
FIG. 2 shows a cross-section of an engine cylinder and intake valve assembly of the current invention.

FIG. 2 is a cross section through line 2—2 of FIG. 1. The two-cycle engine 10 of the current invention is comprised of a standard cylinder 12 and piston 14 arrangement. The piston 14 is connected to the crankshaft 16 through the connecting rod 18. Also seen is the engine intake valve 20. The intake valve is pivotally connected to first end 22 of a tappet or rocker-arm 24. The rocker-arm 24 being pivotally mounted 26 to the engine block. Pivotally connected to the second end 28 of the rocker-arm 24 is a push-rod 30 which functions to apply forces to the rocker-arm so as to open and close the intake valve. The push-rod 30 has first end 32, which is connected to the second end 28 of the first rocker-arm. Coupled to intake manifold 48 is supercharger 53. The supercharger 53 acts to provide air during startup of the engine as well as supplement oxygen to the engine during its normal operation.

The second end 34 of the push-rod 30 is pivotally attached to a first arm 36 of a second rocker-arm 38. The second rocker-arm 38 is pivotally mounted to the engine by a mounting pin 39. Fixed onto the skirt 40 of the piston 14, is a first hardened actuator 42. This actuator 42, is designed so as to engage a hardened portion 46 of the lower rocker-arm 38 which are coupled to the intake valve 20 of the intake manifold 48. It is preferred the actuator be in the form of an actuator cylinder attached to the skirt through standard in-mold casting processes.

Figure 3:
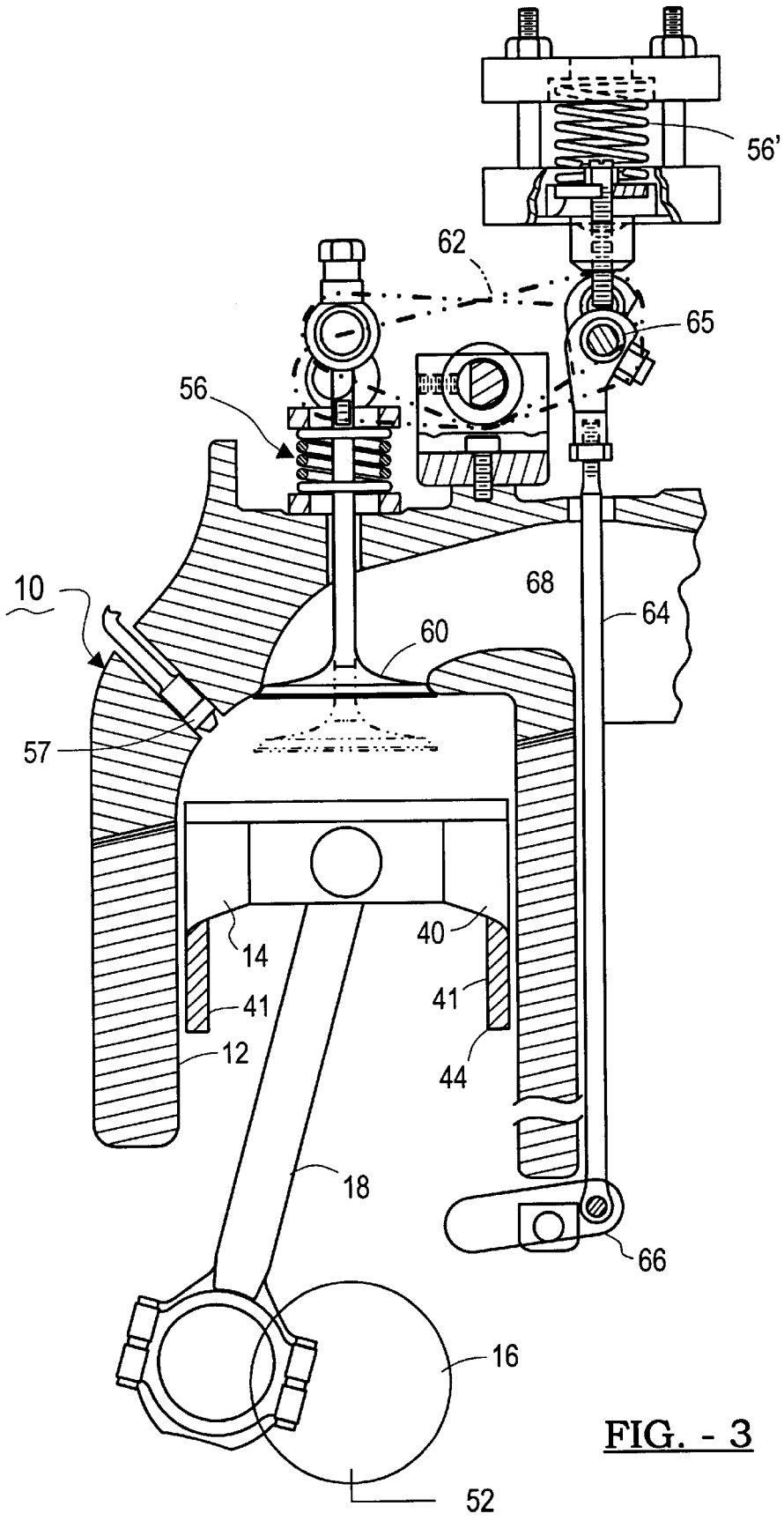
FIG. 3 shows a cross-section of an engine cylinder and exhaust valve assembly of the current invention.

FIG. 3 is a cross section through line 3—3 of FIG. 1. The layout of the cross section is similar to that as shown in the description of FIG. 2. FIG. 3 shows the control mechanism for the exhaust valve 60 of the engine 10 of the current invention. The exhaust valve 60 is pivotally connected to the second upper rocker-arm 62. The second upper rocker-arm functions similarly to the first upper rocker-arm 24, in as much as it is connected to a second lower rocker-arm 66 via a connecting rod 64. The second lower rocker-arm being actuated by a second hardened actuator 44 coupled to the skirt 40 of piston 14. Again, it is preferred the second hardened actuator 44 is machined into the hardened actuating cylinder 41. A notch can be machined into the actuator cylinder 41 to precisely set the height of the first actuator 42. The hardened actuator 42 is configured so it will never contact the cylinder wall 12.

Figure 4:
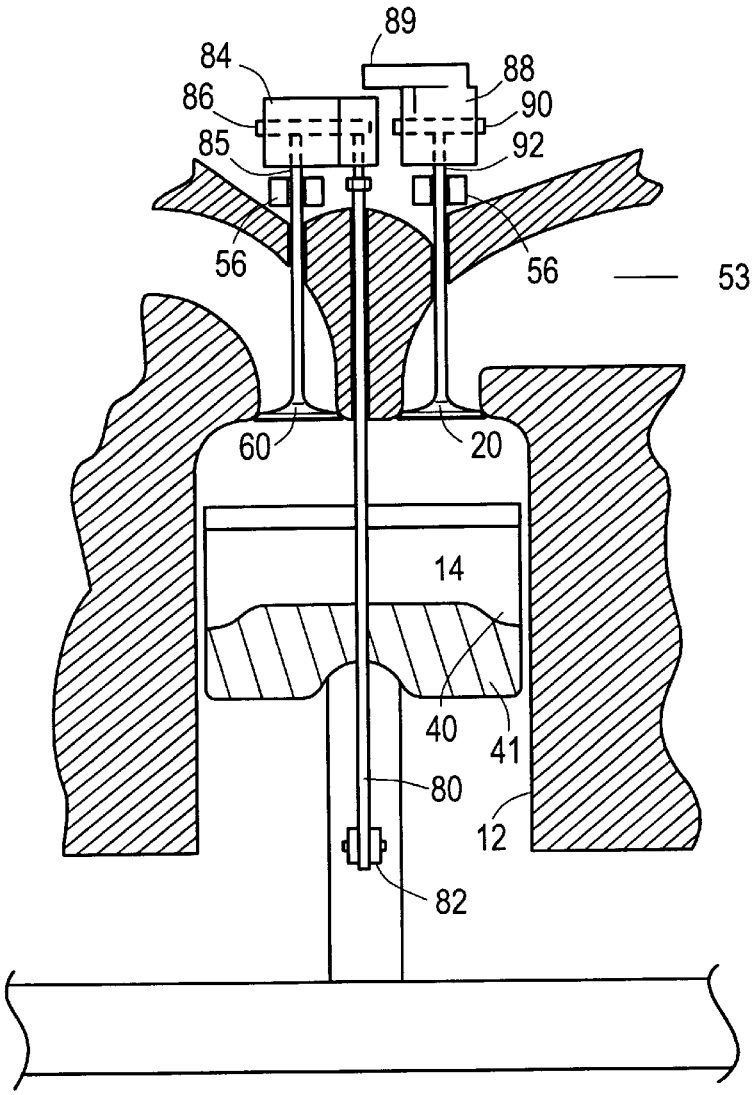
FIG. 4 shows a cross-section of an embodiment of the current invention.

FIG. 4 shows another embodiment of the current invention which uses a single actuating portion 43 of the hardened skirt 41 to control the timing of both the intake 20 and exhaust valve 60. As can be seen, embedded in the skirt 40 of piston 14 is a hardened actuating cylinder 41. The hardened actuating cylinder 41 has a recess 43 which is sized so as to engage a pivotally mounted lower rocker-arm 82. Engagement of this lower rocker-arm and its connection to its push-rod 80 is the same as the mounting and engagement of the lower rocker-arm as described in FIGS. 1 and 2. Push-rod 80 is pivotally coupled to the exhaust rocker-arm 84 at 83. Exhaust rocker arm 84 is pivotally mounted to the engine block through a pivot pin 86. The exhaust valve 60 is pivotally coupled at 85 to the exhaust rocker-arm 84. Disposed next to the exhaust rocker-arm is intake rocker arm 88. Intake rocker-arm 88 is pivotally mounted by pivot pin 90 to the engine. Pivotally connected to the intake rocker-arm at 92 is the intake valve 20. Intake rocker-arm further has a actuating arm 89 for engaging a portion of the exhaust rocker-arm. The space between actuating arm 89 of the intake rocker-arm 88 and the engaging portion of the exhaust rocker arm 84 is set so as to allow a discharge of the compressed exhaust gasses from the cylinder before opening the intake manifold.

To start this two-cycle engine will not be substantially different from starting a four-cycle engine. Turn ignition switch to on. Electrically driven supercharger 53 starts immediately, pumping air into the intake manifold 48. Rotate ignition to "start" position. Engine starter 52 is energized and engine starts to rotate. Assume that the piston 14 in one of the cylinders 12 is at the top of its stroke. As the crankshaft 16 is rotated by the engine starter 52, piston 14 will start moving from its uppermost position (top dead center or TDC) toward its lowest position (bottom dead center, BDC) this involves 180° of crankshaft rotation and common language identifies this movement as one (1) cycle. After about 145° crankshaft rotation from TDC, the hardened actuator 42 added to the bottom skirt of the piston in cylinder 12 will be flush with the bottom of the engine block, and just about to make contact with the second lower rocker-arm 66. It must be remembered that the second lower rocker-arm 66 is connected to the upper rocker-arm 62 via a pull or push rod 64, depending on design. Prescribed clearances will, of course, be employed. As the crankshaft 16 continues to rotate (via the starter motor 52) the piston 14 continues to travel downward and in turn starts to move the lower rocker arm 66 downward. Since this action is transferred to the upper rocker-arm 62, the exhaust valve(s) 60 will start to open. This action is repeated (after a predetermined number of degrees of crankshaft rotation to start opening the intake valves 20. Thus, after the crankshaft has been rotated 180° , both the intake 20, and exhaust valves 54 will be fully opened. At this point, fresh air is flowing into the cylinder 12 and out of the cylinder into the exhaust manifold 68, since both sets of valves 20, 60 are fully opened. Continued rotation of the crankshaft 16 now allows the closing of the valve system by valve springs 56, 56' since the piston will now be travelling toward its TDC. At the moment both sets of valves 20, 60 have closed, the electronic fuel injection system 57 will function to provide fuel into the cylinder, as dictated by the throttle lever position as is known. For the balance of this start cycle, the piston will be travelling toward TDC, compressing the air/fuel mixture. At (or near) TDC, the ignition system will ignite the air/fuel mixture using a standard spark plug 50 (exactly as happens in four-cycle engines) and now the piston will be driven toward BDC and the starter motor will be disengaged.

Figure 5:
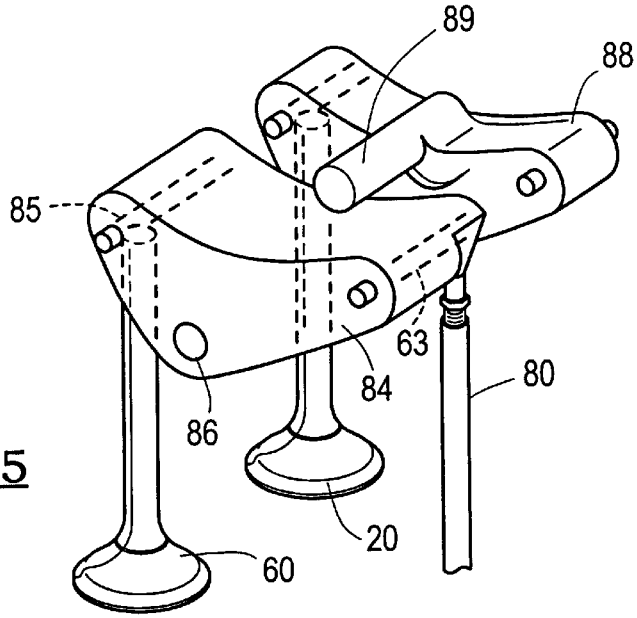
FIG. 5 shows a perspective view of the valve and actuation assembly of the current invention.

The functioning of the embodiment as described in FIGS. 4 and 5 is not significantly different than that described above. As the piston reaches bottom dead center, the actuating groove 43 engages a portion of the lower rocker-arm 82. This applies an upward force to push-rod 80 which in turn actuate the upper exhaust rocker-arm 84. As the upper rocker-arm 84 rotates about its pivot point 86 the exhaust valve 60 opens allowing the release of the compressed exhaust components. As the piston continues to travel downward, the exhaust rocker-arm 84 continues upward engaging the actuating arm 89 of the intake rocker-arm 88. Intake rocker-arm 88 begins to rotate about its pivot point 90 actuating the intake valve 20. The supercharger 53 provides fresh air to the cylinder for the next power stroke. As the crankshaft 16 rotates begins to travel upwards towards top dead center. Valve springs allow the intake 20 and exhaust 60 valves to close. When both valves 20, 60 are closed, the electronic fuel injector 57 will function to provide fuel into the cylinder as dictated by the throttle lever position as is known. At or near TDC, the ignition system will ignite the air/fuel mixture using a standard spark plug 50 and now the piston will be driven towards BDC.

I claim:

1. An engine comprising;

a cylinder;

a piston moveable within said cylinder and having a skirt, said skirt having an actuating number;

an intake valve and an exhaust valve communicating with said cylinder;

a lower rocker arm pivotally connected so as to engage the actuating member;

a push rod pivotally coupled to the lower rocker arm;

a pivotally mounted exhaust rocker arm coupled to said exhaust valve and to said push rod;

a pivotally mounted intake rocker arm having a rocker arm actuating member, said rocker arm actuating member located so as to be engaged by the exhaust rocker arm; and said intake rocker arm being coupled to said intake valve.

* * * * *